US011320144B2

(12) United States Patent
Heinze et al.

(10) Patent No.: US 11,320,144 B2
(45) Date of Patent: May 3, 2022

(54) COMBUSTION CHAMBER ASSEMBLY WITH DIFFERENT CURVATURES FOR A COMBUSTION CHAMBER WALL AND A COMBUSTION CHAMBER SHINGLE FIXED THERETO

(71) Applicant: Rolls-Royce Deutschland Ltd & Co KG, Blankenfelde-Mahlow (DE)

(72) Inventors: Kay Heinze, Ludwigsfelde (DE); Michael Ebel, Rangsdorf (DE); Igor Sikorski, Berlin (DE); Manfred Baumgartner, Berlin (DE); Ivo Szarvasy, Stahnsdorf (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 248 days.

(21) Appl. No.: 16/358,353

(22) Filed: Mar. 19, 2019

(65) Prior Publication Data

US 2019/0293290 A1 Sep. 26, 2019

(30) Foreign Application Priority Data

Mar. 22, 2018 (DE) ..... 10 2018 204 453.8

(51) Int. Cl.
*F23R 3/00* (2006.01)
*F23R 3/06* (2006.01)
(Continued)

(52) U.S. Cl.
CPC ..... *F23R 3/002* (2013.01); *F23M 5/02* (2013.01); *F23R 3/06* (2013.01); *F23R 3/50* (2013.01);
(Continued)

(58) Field of Classification Search
CPC . F23R 3/002; F23R 2900/00005; F23M 5/00; F23M 5/04; F23M 5/08; F01D 11/08
See application file for complete search history.

(56) References Cited

U.S. PATENT DOCUMENTS 4,191,011 A * 3/1980 Sweeney ..... F23R 3/002 431/352
6,397,765 B1 6/2002 Becker
(Continued)

FOREIGN PATENT DOCUMENTS

DE 102012204103 A1 9/2013
EP 1413831 A1 4/2004
(Continued)

OTHER PUBLICATIONS

German Search Report dated Nov. 20, 2018 for counterpart German Patent Application No. 10 2018 204 453.8.

*Primary Examiner* — Todd E Manahan
*Assistant Examiner* — Thuyhang N Nguyen
(74) *Attorney, Agent, or Firm* — Shuttleworth & Ingersoll, PLC; Timothy Klima

(57) ABSTRACT

A combustion chamber assembly group, and a mounting method therefor, includes a combustion chamber for an engine that includes a curved combustion chamber wall extending along two spatial directions, and a combustion chamber shingle affixed at an inner side of the combustion chamber wall and having a shingle edge defining the outer contour of the shingle. For an at least sectional abutment of the shingle edge at the combustion chamber wall with a minimum clamping force in an operational state of the engine, the shingle is mounted to the combustion chamber wall in a mounting state in which the shingle at least at one section of the shingle edge has a curvature with respect to at least one of the spatial directions that differs from the
(Continued)

curvature of the combustion chamber wall with respect to this spatial direction.

14 Claims, 7 Drawing Sheets

(51) Int. Cl.
*F23R 3/50* (2006.01)
*F23M 5/02* (2006.01)

(52) U.S. Cl.
CPC ..... *F23R 2900/00017* (2013.01); *F23R 2900/03044* (2013.01)

(56) References Cited

U.S. PATENT DOCUMENTS

| | | | | |
|---|---|---|---|---|
| 7,093,439 | B2 * | 8/2006 | Pacheco-Tougas | F23R 3/002 60/752 |
| 7,452,183 | B2 * | 11/2008 | Ruthemeyer | F01D 11/005 415/135 |
| 2004/0074239 | A1 | 4/2004 | Tiemann | |
| 2014/0144146 | A1 | 5/2014 | Penz | |
| 2015/0027128 | A1 | 1/2015 | Benkler et al. | |
| 2016/0263656 | A1 | 9/2016 | Scalzo et al. | |

FOREIGN PATENT DOCUMENTS

| | | | |
|---|---|---|---|
| EP | 2738470 | A1 | 6/2014 |
| FR | 2254720 | A1 | 7/1975 |
| WO | 2015069466 | A1 | 5/2015 |

* cited by examiner

COMBUSTION CHAMBER ASSEMBLY WITH DIFFERENT CURVATURES FOR A COMBUSTION CHAMBER WALL AND A COMBUSTION CHAMBER SHINGLE FIXED THERETO

This application claims priority to German Patent Application DE102018204453.8 filed Mar. 22, 2018, the entirety of which is incorporated by reference herein.

DESCRIPTION

The proposed solution relates to a combustion chamber assembly group with a combustion chamber and at least one combustion chamber shingle that is affixed at the combustion chamber wall of the combustion chamber.

Combustion chambers of an engine, in particular of a gas turbine engine, regularly have combustion chamber shingles. Here, a combustion chamber shingle protects the combustion chamber housing forming the combustion chamber wall from the high temperatures that are generated inside the combustion chamber during the combustion of fuel. In order to achieve a sufficiently long service life of the combustion chamber shingles, a ceramic protective layer is usually applied to the hot side of a combustion chamber shingle. Through the combustion chamber shingles, air for cooling and for leaning the combustion, and thus for reducing the NOx emissions, can be guided into the combustion chamber. For this purpose, a combustion chamber shingle often has at least one admixing hole or mixed air hole. Usually, there are also cooling air holes provided at a combustion chamber shingle in order to create a cooling film of cold air on the hot side of the combustion chamber shingle.

For affixing a combustion chamber shingle, usually at least one attachment element, for example in the form of a screw or a bolt, is provided. However, there are also different concepts that are known from practice for affixing a combustion chamber shingle. Different attachment concepts for a combustion chamber shingle of a combustion chamber assembly group can for example be found in EP 1 413 831 A1 and der EP 2 738 470 A1.

Depending on the type of attachment of a combustion chamber shingle at a combustion chamber wall, sections of a combustion chamber shingle do not readily abut the combustion chamber wall at least in certain operational situations of an engine. As a result, the sections of the combustion chamber shingle may vibrate freely and—in the event of high-frequency vibrations—these sections may be prone to failure due to fatigue failure. Against this background, additional attachment elements are usually provided, which press a combustion chamber shingle against the combustion chamber wall by exerting a comparatively high pressing force. However, providing additional attachment elements entails increased costs and a higher mounting effort.

Thus, there is the need for a combustion chamber assembly group for an engine that is improved in this regard.

Accordingly, it is provided in the proposed combustion chamber assembly group that the at least one combustion chamber shingle, which is fixated at an inner side of the combustion chamber wall and has a shingle edge that defines the outer contour of the combustion chamber shingle, has a curvature at least in one section of the shingle edge with respect to at least one of two spatial directions along which the curved combustion chamber wall extends that differs from a curvature of the combustion chamber wall with respect to this spatial direction, in a (cold) mounting state in which the combustion chamber shingle can be mounted at the combustion chamber wall. In this manner, it is achieved that, via its shingle edge, the combustion chamber shingle abuts the combustion chamber wall at least in certain sections with a minimum clamping force in an operational state of the engine.

Thus, the curvatures of at least one section of the shingle edge and of the combustion chamber wall at which the shingle edge is supposed to abut differ from each other and—in contrast to customary configurations as they are known from practice—thus extend so as to be substantially not parallel to each other. An outer contour of the combustion chamber shingle thus does not follow the contour of an inner side of the combustion chamber wall facing the combustion space of the combustion chamber, or follows it only partially.

The shingle edge extends circumferentially about a shingle base body of the combustion chamber shingle. If this shingle edge abuts the combustion chamber wall in certain sections with a minimum clamping force when the engine is in operation, a free vibration of any sections of the combustion chamber shingle can be avoided.

The at least one section of the shingle edge which is supposed to abut the combustion chamber wall with a minimum clamping force thus for example has a curvature with respect to at least one of the spatial directions which differs by a predetermined measure from the curvature of the combustion chamber wall with respect to this spatial direction. Here, the predetermined measure is chosen in such a manner that, in the (reference) operational state of the engine (which is e.g. defined by one or multiple different operating points of the engine), the at least one section of the combustion chamber shingle abuts at the combustion chamber wall with at least the minimum clamping force, and any vibration of the part of the combustion chamber shingle that comprises the shingle edge section relative to the combustion chamber wall is prevented. In one embodiment variant, the predetermined measure by which the curvatures of the shingle edge, on the one hand, and the combustion chamber wall, on the other hand, differ from each other, are chosen in such a manner that the at least one section of the shingle edge always abuts the combustion chamber wall at least with the minimum clamping force during operation of the engine, and thus in all provided operating points of the engine.

Consequently, in the proposed solution, the curvatures of the combustion chamber wall that differ from each other by a predetermined measure in the area of the combustion chamber shingle to be affixed, on the one hand, and of a shingle edge of the combustion chamber, on the other hand, do not result from the fixation of the combustion chamber shingle at the combustion chamber wall and any tensions that may possibly be created in this way. Rather, the provided different curvatures are already present in the fixated state of the combustion chamber shingle not according to the intended use, and thus in the nominal cold mounting state of the combustion chamber assembly group.

Through the shape-related abutment of the shingle edge of the combustion chamber shingle at the combustion chamber wall, the shingle edge always abuts the combustion chamber wall with a slight pressing force. Thus, in the broadest sense, the combustion chamber shingle and the combustion chamber wall can form a disc spring connection. Here, the size of a combustion chamber shingle that is small as compared to the combustion chamber wall can facilitate a comparatively great (radial) deformation of a shingle base body at the shingle edge while at the same time facilitating comparatively low internal tension and low reaction forces at the shingle edge. On the one hand, these comparatively low reaction forces can reduce pre-stress loss due to creeping inside the combustion chamber shingle and friction wear between the shingle edge and the combustion chamber wall. Further, with the usual dimensions of a combustion chamber shingle, even a long deformation path does not result in a rapidly decreasing pressing force, even if pre-stress loss occurs due to low reaction forces.

In one embodiment variant, the curvature in at least one section of the shingle edge is smaller with respect to at least one of the spatial directions than the curvature of the combustion chamber wall with respect to this spatial direction. This may for example include that a section of the shingle edge extending in the circumferential direction and/or a section of the shingle edge extending along an axial direction has a smaller curvature than the combustion chamber wall. What is understood here by an axial direction along which the combustion chamber wall extends as one of the two spatial directions may for example be a longitudinal direction, which in the mounted state of the combustion chamber assembly group according to the intended use defines the flow direction of the fuel air mixture through the combustion chamber in the direction of the turbine stage. The circumferential direction is oriented about this axial direction.

A ratio between the curvature of the combustion chamber wall and the smaller curvature of the at least one section of the shingle edge can for example be in the range of 1.03 to 1.4. It has been shown that with a ratio of the curvatures (curvature ratio) in this range, a sufficiently high adjustment of the shingle edge to the combustion chamber can be achieved via the operating points of the engine. For example, the ratio between the curvature of the combustion chamber wall and the smaller curvature of the at least one section of the shingle edge is in the range between 1.03 and 1.2. This in particular includes ranges from 1.03 to 1.1, in particular a range from 1.03 to 1.08, and a range from 1.035 to 1.055 for the curvature ratio.

In one embodiment variant, the curvature can be larger in at least one section of the shingle edge with respect to at least one of the spatial directions than the curvature of the combustion chamber wall with respect to this spatial direction. A larger curvature of a section of the shingle edge is for example advantageous in a combustion chamber shingle that is affixed at a radially inner combustion chamber wall of the combustion space with respect to the circumferential direction. In particular in such a case, a ratio between the curvature of the combustion chamber wall and the larger curvature at the at least one section of the shingle edge can be in the range from 0.7 to 0.98, for example.

In one embodiment variant, it can be provided alternatively or additionally that (a) a first curvature of at least one first section of the shingle edge is smaller with respect to at least one first spatial direction of the two spatial directions along which the combustion chamber wall extends than the curvature of the combustion chamber wall with respect to this first spatial direction, and (b) a second curvature at least at one second section of the shingle edge is larger with respect to at least one second spatial direction of the two spatial directions than the curvature of the combustion chamber wall with respect to this second spatial direction. This for example also includes the variant in which a combustion chamber shingle has a first curvature in the axial direction (axis direction) that is smaller than a curvature of the combustion chamber wall with respect to the axial direction, and further has a second curvature in the circumferential direction that is larger than the curvature of the combustion chamber wall with respect to the circumferential direction. Such a geometry of a combustion chamber wall and a combustion chamber shingle may for example be provided for a—in the cross section of the engine and with respect to a central or rotational axis of the engine—radially inner combustion chamber shingle and a radially inner combustion chamber wall.

Also, a combustion chamber assembly group can be provided in which the (a) first curvature is smaller at least in one first section of the shingle edge with respect to at least one first spatial direction of the two spatial directions along which the combustion chamber wall extends than the curvature of the combustion chamber wall with respect to this first spatial direction, and (b) a second curvature is also smaller at least in one second section of the shingle edge with respect to at least one second spatial direction of the two spatial directions than the curvature of the combustion chamber wall with respect to this second spatial direction. Such a configuration in which a ratio between the curvature of the shingle edge and the curvature of the combustion chamber wall with respect to both spatial directions may e.g. be in the previously mentioned range between 1.03 to 1.4, is provided in one embodiment variant, for example for a radially outer combustion chamber shingle at a radially outwardly located combustion chamber wall of the combustion chamber.

In one embodiment variant, the two previously described alternatives are combined, so that, depending on whether it is affixed at a radially inner or a radially outer combustion chamber wall of the combustion chamber, a combustion chamber shingle (a) has a smaller curvature along both spatial directions than the combustion chamber wall, or (b) has a smaller curvature only along one spatial direction, but has a larger curvature in the other spatial direction. Thus, it may for example apply for a curvature ratio $\Delta\kappa$ of an inner combustion chamber shingle in the axial direction (axis direction) that $1.03 \leq \Delta\kappa < 1.4$ and in the circumferential direction that $0.7 < \Delta\kappa \leq 0.98$. In contrast, it may apply for an outer combustion chamber shingle in the axial direction (axis direction) as well as in the circumferential direction that $1.03 \leq \Delta\kappa < 1.4$. Here, the indicated curvature relationships generally refer to a mounting state and thus a nominal, cold state of the combustion chamber assembly group.

In one embodiment variant, a curvature radius of the combustion chamber wall in the area of a combustion chamber shingle affixed thereto may for example be in the range of 200 mm to 250 mm, in particular in the range of 210 mm to 230 mm, and approximately at approximately 220 mm. In that case, a curvature could for example be in the range from $4.3\times10^{-3}$ to $4.8\times10^{-3}$, in particular in the range from $4.45\times10^{-3}$ to $4.65\times10^{-3}$, and approximately at $4.5\times10^{-3}$. By comparison, a curvature radius of a shingle edge (along the same spatial direction) may for example be in the range from 215 mm to 260 mm, in particular in the range from 225 mm to 240 mm, and in particular at approximately 230 mm, and thus a curvature in the range from $4.2\times10^{-3}$ to $4.5\times10^{-3}$, in particular in the range from $4.25\times10^{-3}$ to $4.4\times10^{-3}$, and particularly at approximately $4.3\times10^{-3}$. Based on this, a curvature ratio $\Delta\kappa$ of a curvature of the combustion chamber wall to the curvature of the shingle edge is typically in the range from 1.03 to 1.4.

In principle, the combustion chamber wall may for example extend along a (first) spatial direction, the axial direction or axis direction, which is substantially in parallel to a flow direction through the combustion chamber, and a (second) spatial direction which extends along a circular path about the first spatial direction, the circumferential direction.

As a part of the proposed solution, also a gas turbine engine with a combustion chamber is provided, comprising at least one embodiment variant of a proposed combustion chamber assembly group.

A further aspect of the proposed solution relates to a method for producing a combustion chamber assembly group.

Here, the combustion chamber assembly group to be produced comprises a combustion chamber for an engine, which comprises at least one curved combustion chamber wall extending along two spatial directions, as well as at least one combustion chamber shingle which is to be affixed at an inner side of the combustion chamber wall via at least one attachment element, such as for example a bolt or a screw, and has a shingle edge that defines the outer contour of the combustion chamber shingle.

As a part of the proposed manufacturing method, for an at least sectional abutment of the shingle edge at the combustion chamber wall with a minimum clamping force in an operational state of the engine, the combustion chamber shingle is mounted at the combustion chamber wall in a (cold) mounting state, in which the combustion chamber shingle has a curvature at least in one section of the shingle edge with respect to at least one of the spatial directions that differs from the curvature of the combustion chamber wall with respect to this spatial direction.

With the proposed manufacturing method, in particular an embodiment variant of a proposed combustion chamber assembly group can be manufactured. Thus, the advantages and features for embodiment variants of a proposed combustion chamber assembly group that are explained above and in the following also apply to the embodiment variants of a proposed manufacturing method, and vice versa.

Thus, analogously to a proposed combustion chamber assembly group, for example a curvature of at least one section of the shingle edge with respect to one of the spatial directions can differ by a predetermined measure from a curvature of the combustion chamber wall with respect to this spatial direction, and this predetermined measure can be chosen in such a manner that in the operational state of the engine the at least one section of the combustion chamber shingle always abuts the combustion chamber wall at least with the minimum clamping force, whereby a vibration of the at least one section of the combustion chamber wall relative to the combustion chamber is prevented.

For example, the at least one section of the shingle edge has a curvature with respect to at least one of the two spatial directions that differs by a predetermined measure from the curvature of the combustion chamber wall with respect to this spatial direction. Here, the predetermined measure by which the curvatures differ from each other is determined for example depending on the strength of the minimum clamping force, a natural frequency of the combustion chamber shingle and/or a temperature difference between the combustion chamber shingle and the combustion chamber wall in the operational state of the engine (e.g. at a certain operating point), with the thermal expansion coefficients of the combustion chamber shingle and the combustion chamber wall being known. In principle, the different curvatures of the combustion chamber wall and of the shingle edge of the combustion chamber can be designed by taking into account a temperature difference that occurs in the operational state of the engine between the combustion chamber wall and the combustion chamber shingle. Such a temperature difference can be between 50 K and 800 K.

A combustion chamber assembly group provided in this manner, in which the predetermined measure is determined depending on the strength of the minimum clamping force, a natural frequency of the combustion chamber shingle and/or a temperature difference between the combustion chamber shingle and the combustion chamber wall in the operational state of the engine, thus provides that—under consideration of the respective mechanical and thermal loads and deformations to the combustion chamber assembly group mounted therein as they occur during operation of the engine—the combustion chamber shingle always abuts the combustion chamber wall via its shingle edge with a pressing force, and thus is hindered from vibrating.

In one embodiment variant, the at least one section of the shingle edge has a curvature with respect to at least one of the spatial directions that differs by a predetermined measure from the curvature of the combustion chamber wall with respect to this spatial direction, wherein the predetermined measure is consequently chosen in such a manner that in the operational state of the engine any vibration of the at least one section of the combustion chamber shingle relative to the combustion chamber wall is prevented. Thus, the predetermined measure can for example be determined in a computer-aided manner, namely such that an at least sectional abutment of the shingle edge at the combustion chamber wall with the minimum clamping force is always ensured through the operational state of the engine according to the intended use, and thus the provided operating points, as well as the environment conditions that are present in the combustion space. Here, the geometry of the shingle edge may for example be predetermined in such a manner that the sections of the combustion chamber shingle that are most prone to a free vibration are always in contact with the combustion chamber wall. For this purpose, in particular a natural frequency of the combustion chamber shingle and an expected excitation during operation of the engine are taken into account.

In one embodiment variant with a predefined combustion chamber wall, the combustion chamber shingle is deformed and correspondingly curved to obtain the different curvatures of the combustion chamber wall and the combustion chamber shingle, in particular the above-mentioned ratios between the curvature of the combustion chamber wall and the curvature of the shingle edge with respect to the different spatial directions. Thus, as a part of the manufacturing method, a combustion chamber shingle is deformed with a curvature at least at its shingle edge, but possibly additionally also at the shingle base body that is encloses by the shingle edge, which in the operational state of the engine ensures the at least sectional abutment of the shingle edge at the combustion chamber wall with a minimum clamping force.

In principle, it can alternatively also be provided that, with a predefined combustion chamber shingle, the combustion chamber wall is at least locally deformed and correspondingly curved to obtain the different curvatures of the combustion chamber wall and the combustion chamber shingle, in particular the curvature relationships as indicated above.

In principle, the curvatures of the combustion chamber wall and the combustion chamber shingle can be adjusted to each other to obtain an abutment at least of a certain section of the shingle edge with the minimum clamping force in the operational state of the engine. This in particular includes that the combustion chamber wall as well as the combustion chamber shingle are correspondingly deformed to obtain a contact that is as extensive as possible between the shingle edge and the combustion chamber wall at the operating points that characterize the operational state of the engine.

In particular, the curvature relationships can be chosen in such a manner that in the operational state of the engine, that is, in at least one particular operating point of the engine, a curvature of the combustion chamber wall and a curvature of the shingle edge substantially correspond due to the occurring mechanical and thermal loads. While the shingle edge of the combustion chamber shingle and the combustion chamber wall accordingly still have different curvatures in the mounting state, and the combustion chamber shingle may even be out of contact from the combustion chamber wall with its shingle edge, the combustion chamber shingle can be formed and curved in such a manner that in the (hot) operational state of the engine not only an abutment with the minimum clamping force is ensured, but that the combustion chamber wall and the shingle edge also have a substantially identical curvature.

The accompanying Figures illustrate possible embodiment variants of the proposed solution by way of example. Herein:

Figure 1A:
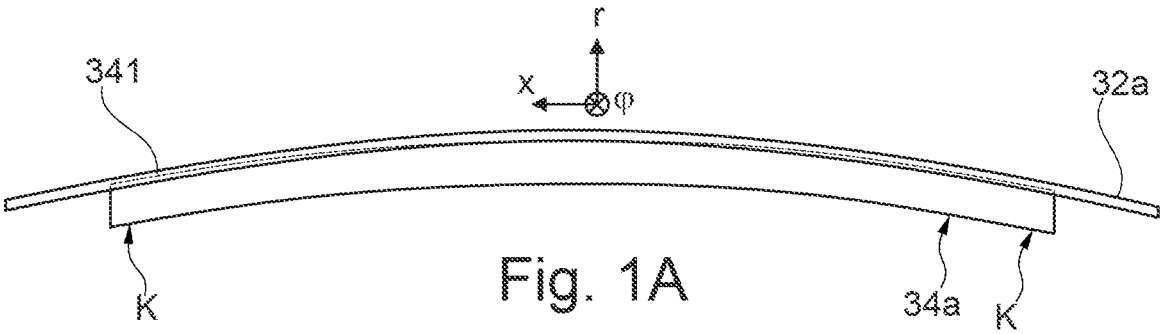
FIG. 1A shows, in sections and in a side view, a radially inner combustion chamber wall of an embodiment variant of a proposed combustion chamber assembly group with a combustion chamber shingle affixed thereat, which in the axial direction has a smaller curvature than the radially inner combustion chamber wall.
Figure 1B:
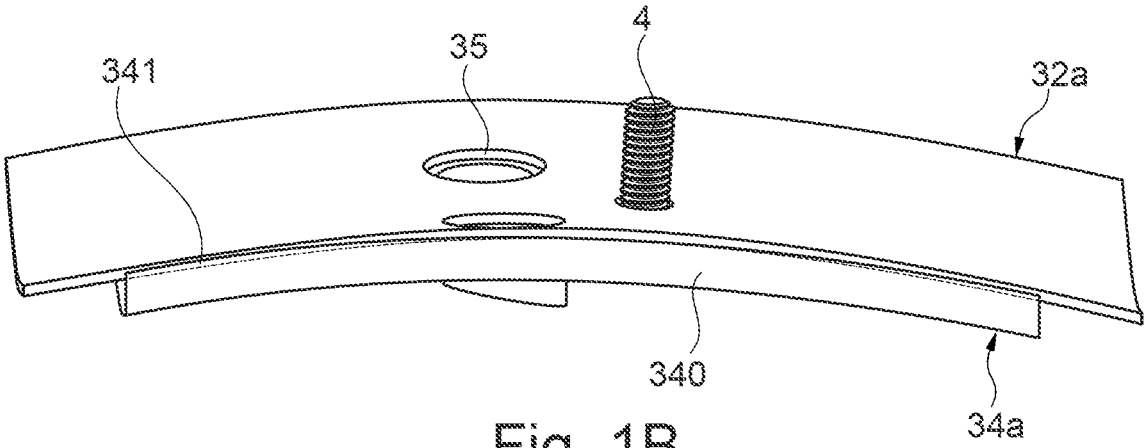
FIG. 1B shows the combustion chamber assembly group of FIG. 1A in a perspective view.
Figure 2:
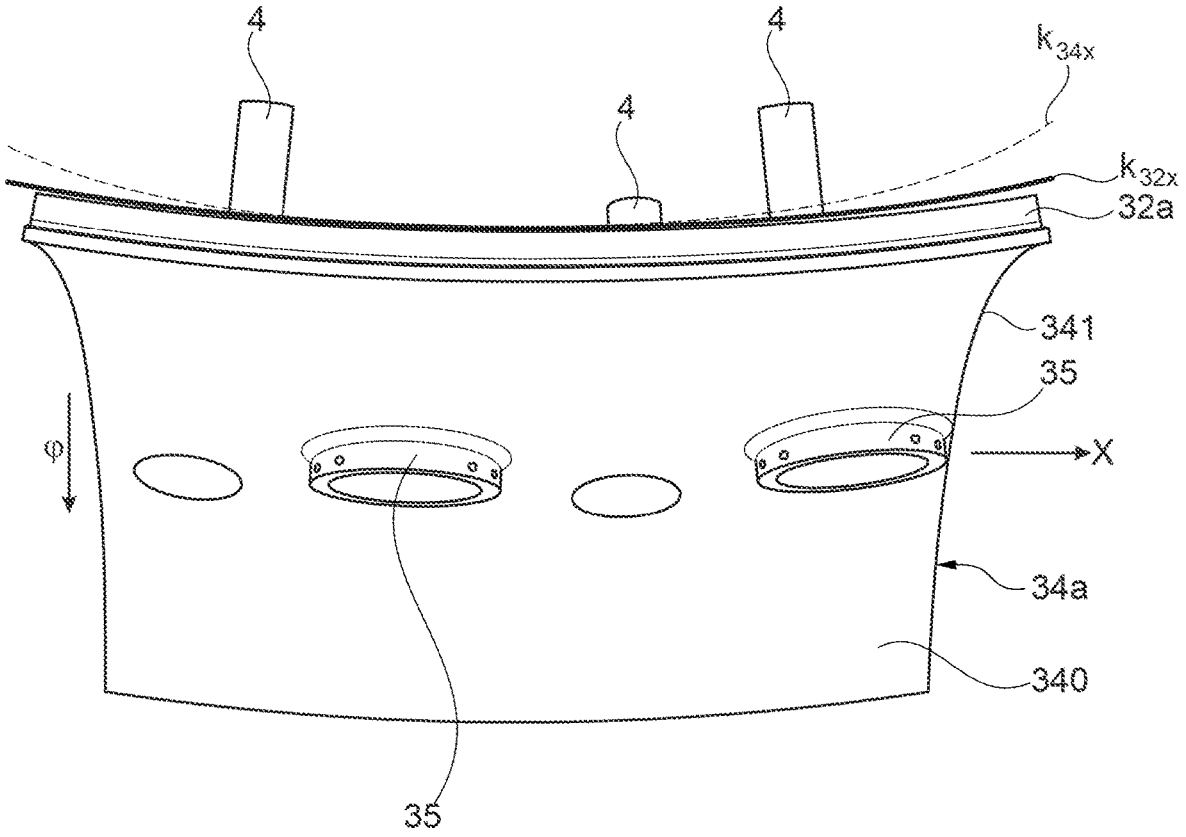
Figure 3:
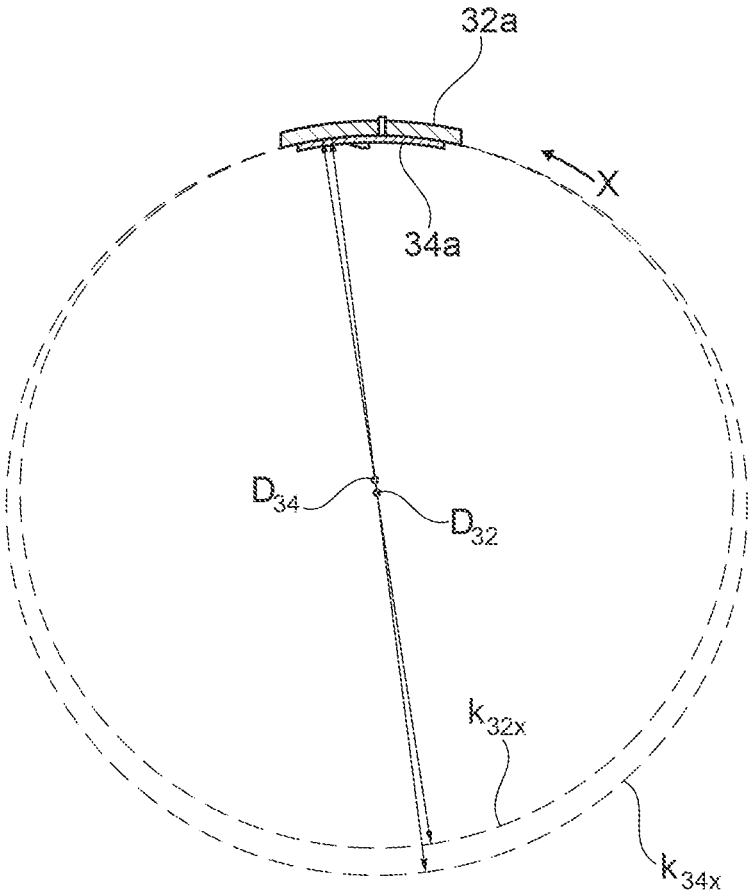
Figure 4A:
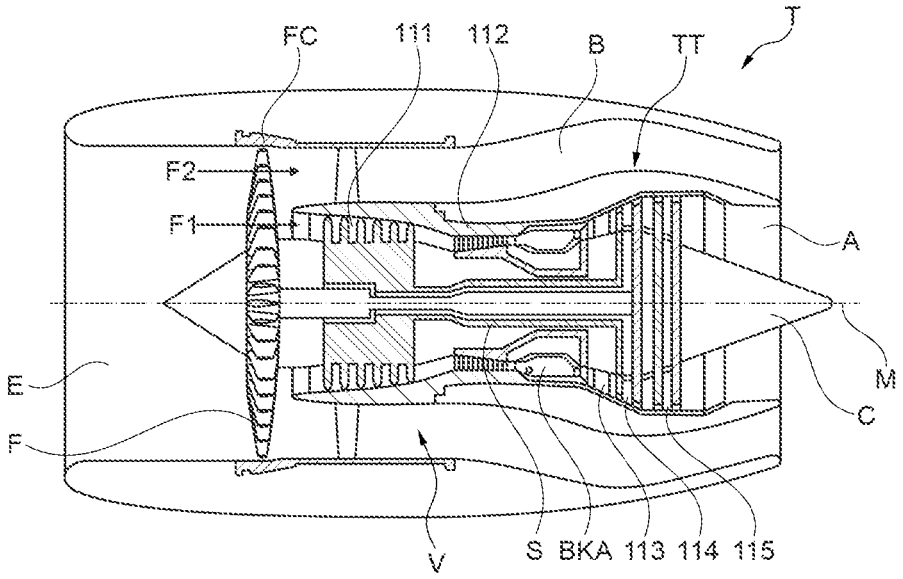
Figure 4B:
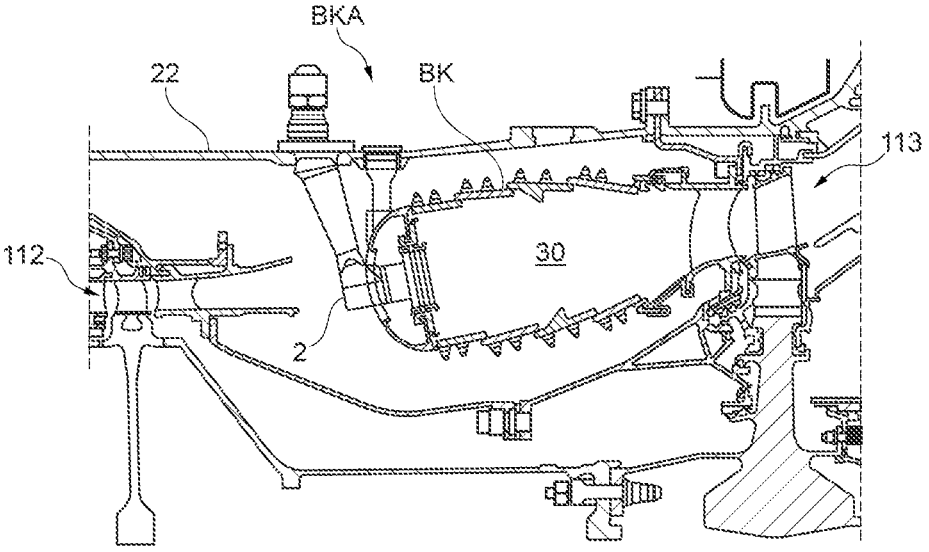
Figure 4C:
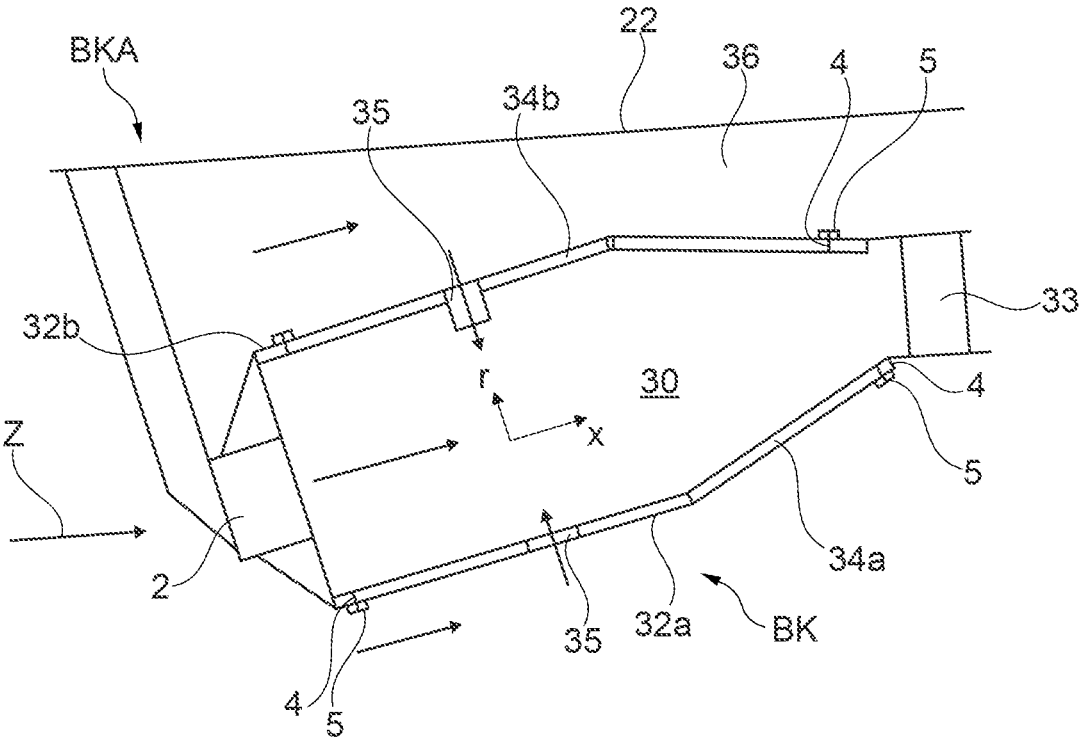
Figure 5:
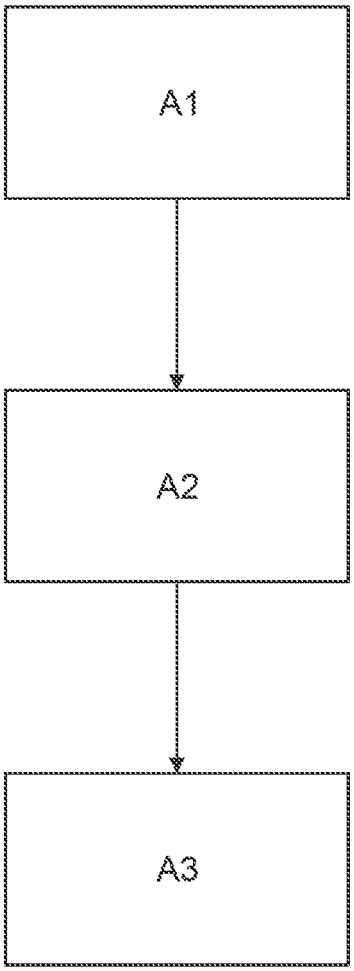

FIG. 2 shows, in a perspective view, a combustion chamber assembly group, illustrating the different curvature lines for a shingle edge of the combustion chamber shingle, on the one hand, and the radially inner combustion chamber wall, on the other hand, also showing the curvature of the combustion chamber shingle by way of comparison, which in the cold mounting state of the combustion chamber assembly group corresponds to the curvature of the radially inner combustion chamber wall;

FIG. 3 shows an illustration of different curvature radiuses of the radially inner combustion chamber wall and the combustion chamber shingle corresponding to the embodiment variant of FIGS. 1A and 1B;

FIG. 4A shows a schematic sectional view of a gas turbine engine in which the proposed combustion chamber assembly group is used;

FIG. 4B shows a schematic sectional view of a combustion chamber of the gas turbine engine of FIG. 4A;

FIG. 4C shows, in sections, an enlarged sectional view of a combustion chamber with a combustion chamber shingle;

FIG. 5 shows a flowchart for an embodiment variant of a proposed manufacturing method.

FIG. 4A schematically illustrates, in a sectional view, a (turbofan) engine T in which the individual engine components are arranged in succession along a rotational axis or central axis M and the engine T is embodied as a turbofan engine. By means of a fan F, air is suctioned in along an entry direction at an inlet or an intake E of the engine T. This fan F, which is arranged inside a fan housing FC, is driven by means of a rotor shaft S that is set into rotation by a turbine TT of the engine T. Here, the turbine TT connects to a compressor V, which for example has a low-pressure compressor 111 and a high-pressure compressor 112, and where necessary also a medium-pressure compressor. The fan F supplies air to the compressor V in a primary air flow F1, on the one hand, and, on the other, to a secondary flow channel or bypass channel B in a secondary air flow F2 for creating a thrust. Here, the bypass channel B extends about a core engine that comprises the compressor V and the turbine TT, and also comprises a primary flow channel for the air that is supplied to the core engine by the fan F.

The air that is conveyed by means of the compressor V into the primary flow channel is transported into the combustion chamber section BKA of the core engine where the driving power for driving the turbine TT is generated. For this purpose, the turbine TT has a high-pressure turbine 113, a medium-pressure turbine 114, and a low-pressure turbine 115. The turbine TT drives the rotor shaft S and thus the fan F by means of the energy that is released during combustion in order to generate the necessary thrust by means of the air that is conveyed into the bypass channel B. The air from the bypass channel B as well as the exhaust gases from the primary flow channel of the core engine are discharged by means of an outlet A at the end of the engine T. Here, the outlet A usually has a thrust nozzle with a centrally arranged outlet cone C.

FIG. 3B shows a longitudinal section through the combustion chamber section BKA of the engine T. Here, in particular an (annular) combustion chamber BK of the engine T can be seen, which forms an embodiment variant of a proposed combustion chamber assembly group. A nozzle assembly group is provided for injecting fuel or an air-fuel-mixture into a combustion space 30 of the combustion chamber BK. It comprises a combustion chamber ring along which multiple fuel nozzles 2 are arranged along a circular line about the central axis M. Here, the nozzle exit openings of the respective fuel nozzles 2 that are positioned at the combustion chamber ring are provided at the combustion chamber ring R. Here, each fuel nozzle 2 comprises a flange by means of which a fuel nozzle 2 is screwed to an outer housing 22 of the combustion chamber section BKA.

The enlarged sectional view of FIG. 4C shows a more detailed rendering of an embodiment of a combustion chamber BK of the combustion chamber section BKA. Here, the combustion chamber BK comprises the fuel nozzle 2 that is supported in a combustion chamber head. Via the fuel nozzle 2, fuel is injected into the combustion space 30 of the combustion chamber BK. The exhaust gases of the mixture that is combusted inside the combustion space 30 are transported in the axial direction x via a preliminary turbine guide row 33 to the high-pressure turbine 113 to set the turbine stages in rotation.

The combustion space 30 is delimited by—with respect to the central M of the engine T—radially inner and radially outer combustion chamber walls 32*a*, 32*b* of a combustion chamber housing of the combustion chamber BK which respectively extend along the axial direction x, on the one hand, and, on the other hand, along a circumferential direction φ about this axial direction x. The combustion chamber walls 32*a* and 32*b* thus extend along the axial direction x along the central axis M as well as along the circumferential direction φ. A radial direction r extends perpendicular to the axial direction x as well as to the circumferential direction φ. Along this radial direction r, air may flow via admixing holes 35 into the combustion space 3, for example.

Arranged at the inside at the combustion chamber walls 32*a*, 32*b* are combustion chamber shingles 34*a*, 34*b*. The combustion chamber walls 32*a*, 32*b* thus enclose the combustion space 30 of the combustion chamber BK and support the combustion chamber shingles 34*a*, 34*b* with which the combustion chamber walls 32*a*, 32*b* is cladded in order to facilitate additional cooling and to withstand the high temperatures that are present inside the combustion space 30.

Here, the combustion chamber shingles 34*a*, 34*b* are respectively supported by means of one or multiple bolts 4 at the respective inner or outer combustion chamber wall 32*a*, 32*b*. At that, each bolt 4 passes through an opening at the combustion chamber wall 32*a* or 32*b*, and is affixed at the combustion chamber wall 32*a* or 32*b* by means of respectively one nut 5. For example, cooling of the respective combustion chamber shingle 34*a* or 34*b* is facilitated via multiple effusion cooling holes that are provided at the combustion chamber shingle 34*a* or 34*b*. In addition, the combustion chamber shingle 34*a*, 34*b* can have at least one admixing hole 35 through which air from the surrounding exterior space can flow into the combustion space 30. Here, the air that flows through the admixing hole 35 serves for cooling and/or leaning the combustion.

Here, the exterior space that surrounds the combustion chamber BK, for example in the form of an annular channel, forms an air supply 36 for the admixing holes 35 (and any effusion cooling holes that may be present). At that, air that flows into the combustion chamber BK along an inflow direction Z is divided in the area of the fuel nozzle 2 by a section that is designed in a hood-like manner into a primary airflow for the combustion space 30 and a secondary airflow for the surrounding exterior space with the air supply 36. Here, the air usually flows into the combustion chamber BK via diffusor (not shown).

The fixation of the combustion chamber shingles 34*a*, 34*b* at a combustion chamber wall 32*a*, 32*b* is realized by means of a bolt 4, which may e.g. formed integrally with a combustion chamber shingle 34*a* or 34*b*, as illustrated in FIGS. 1B and 2 by way of example for an inner combustion chamber shingle 34*a*. Here, a bolt shaft of a bolt 4 that is formed at the inner side of the combustion chamber shingle 34*a* has a thread at its top end. The combustion chamber shingle 34*a* is affixed at the combustion chamber wall 32*a* according to the intended use by the bolt shaft being passed through an opening at the combustion chamber wall 32*a* and being screwed onto a nut 5 from the outside, so that the combustion chamber shingle 34*a* is supported internally against the combustion chamber wall 32*a*.

The support of the combustion chamber shingles 34*a* or 34*b* against the respective combustion chamber wall 32*a* or 32*b* can strongly depend on the operational state of the engine T. If no abutment at the respective combustion chamber wall 32*a* or 32*b* is provided at the shingle edge 341 of a combustion chamber shingle 32*a*, 32*b*, a section of the combustion chamber shingle 34*a* or 34*b* may be able to vibrate freely during operation of the engine. In the case of high-frequency vibrations, such a possibility of free vibration may lead to a heightened risk of failure due to fatigue failure. To prevent vibration in particular of an edge-side section of the combustion chamber shingle 34*a* 34*b* relative to the combustion chamber wall 32*a*, 32*b* at which the combustion chamber shingle 34*a*, 34*b* is affixed, it is therefore provided in a proposed solution that, in a cold mounting state, the combustion chamber shingle 34*a*, 34*b* and the combustion chamber wall 32*a*, 32*b* have curvatures that differ from each other by a predetermined measure with respect to at least one of the spatial directions x and φ, along which the combustion chamber wall 32*a* or 32*b* extends.

According to the proposed solution, at least at one circumferential shingle edge 341, a combustion chamber shingle 34*a* or 34*b* is provided with a curvature Δκ that differs in the cold mounting state from a curvature of a combustion chamber wall 32*a* or 32*b* at which the combustion chamber shingle 34*a* or 34*b* is affixed. However, in principle also a shingle base body 340 circumferentially surrounded by the shingle edge 341 may be correspondingly curved. Here, the curvature differences between a combustion chamber shingle 34*a*, 34*b* and the associated combustion chamber wall 32*a* or 32*b* are in particular determined by the strength of a minimum clamping force K with which a shingle edge 341 of a combustion chamber shingle 34*a*, 34*b* is to abut an associated combustion chamber wall 32*a* or 32*b* during operation of the engine T, on a natural frequency of the combustion chamber shingle 34*a*, 34*b*, and/or on a temperature difference between the combustion chamber shingle 34*a*, 34*b* and the combustion chamber wall 32*a*, 32*b* during operation of the engine T—with the thermal expansion coefficients of the combustion chamber shingle 34*a*, 34*b* and the combustion chamber wall 32*a*, 32*b* being known—, and thus on the mechanical and thermal loads that act during operation of the engine T, including the occurring thermal deformations at the combustion chamber wall 32*a*, 32*b* and the combustion chamber shingle 34*a*, 34*b*. Here, the different curvatures of the combustion chamber wall 32*a*, 32*b*, on the one hand, and the combustion chamber shingle 34*a*, 34*b* at its shingle edge 341, on the other hand, are adjusted to each other in such a manner that, during operation of the engine T and thus at predefined operating points of the engine T, an abutment of the shingle edge 341 of a combustion chamber shingle 34*a*, 34*b* with a minimum clamping force is ensured at least in certain sections and free vibration of the combustion chamber shingle 34*a*, 34*b* is prevented at least in the section of the shingle band 341 that abuts with the minimum clamping force.

FIGS. 1A and 1B show a possible geometry of the inner combustion chamber shingle 34*a* and the inner combustion chamber wall 32*a* in different views. In particular along the axial direction x, the inner combustion chamber shingle 34*a* has a curvature $\kappa_{34}$ that is smaller than a curvature $\kappa_{32}$ of the inner combustion chamber wall 32*a* in the axial direction x. Here, the curvature differences are chosen in such a manner that the combustion chamber shingle 34*a* is always pressed against the inner side of the combustion chamber wall 32*a* at least with a minimum clamping force K in the operational state of the engine T (at predefined operating points). At that, a radius of the combustion chamber wall 32*a* may for example be approximately 220 mm, while the radius of the shingle edge 341 along the axial direction x is in the range of about 230 mm. This results in a curvature $\kappa_{32}$ of the combustion chamber wall 32*a* along the axial direction x in the range of approximately $4.5\times10^{-3}$ and a curvature $\kappa_{34}$ of the shingle edge 341 (as well as possibly also of the shingle base body 340) along the axial direction x in the range of $4.3\times10^{-3}$. A ratio Δκ between the curvature of the combustion chamber wall 32*a* $\kappa_{32}$ and the curvature of the shingle edge 341 of the combustion chamber shingle 34*a* $\kappa_{34}$ is thus approximately 1.045.

Thus, in the (cold) mounting state of the combustion chamber assembly group, a curvature of a combustion chamber shingle 34*a* or 34*b* corresponding to FIGS. 1A and 1B does not follow a curvature of a combustion chamber wall 34*a* or 34*b* at which the combustion chamber shingle 34*a* or 34*b* is to be affixed. The curvatures are in particular chosen to differ in such a manner that an abutment of the shingle edge 341 at the combustion chamber wall 32*a* or 32*b* with a contact pressure is always ensured through the provided operating points of the engine T. For this purpose, the respective combustion chamber shingle 34*a*, 34*b* is for example correspondingly deformed, given a predefined geometry of the combustion chamber wall 32*a* or 32*b*.

FIG. 2 provides a perspective rendering in which the curvature differences are illustrated based on the curvature lines $k_{34x}$ and $k_{32x}$ which are followed by the curvature of the combustion chamber wall 32*a* or of a shingle edge 341 of the combustion chamber shingle 34*a*. The combustion chamber shingle 34*a* or 34*b*, which is pre-curved in a manner that differs from the geometry of the associated combustion chamber wall 32*a* or 32*b*, does not follow the curvature of the combustion chamber wall 32*a* or 32*b* in the mounting state. In this context, it is in particular conceivable that a circumferential shingle edge 341 of a combustion chamber shingle 34*a* or 34*b* is not in any contact with the combustion chamber wall 32*a* or 32*a* after mounting, and thus when the engine T is not in operation, and the predefined abutment under contact pressure occurs only through the loads exerted from the outside and/or the developing temperature field in the combustion chamber shingle 34*a*, 34*b* and the combustion chamber wall 32*a*, 32*b* due to the resulting deformations.

Referring to FIGS. 1A and 1B, FIG. 3 illustrates by way of example different curvature radiuses for the inner combustion chamber wall 32*a*, on the one hand, and the inner combustion chamber shingle 34*a*, on the other hand, with respect to the axial direction x. In the shown variant, a curvature radius $D_{32}/2$ of the combustion chamber wall 32*a* may for example be approximately 220 mm, and thus a curvature is approximately $4.5\times10^{-3}$, while a curvature radius $D_{34}/2$ of the shingle edge 341 of the combustion chamber shingle 34*a* is approximately 230 mm, and thus a curvature is approximately $4.3\times10^{-3}$.

However, corresponding to the shown embodiment variants of FIGS. 1A to 3, a shingle edge 341 of a combustion chamber shingle 34*a* or 34*b* can thus have a curvature that differs from the combustion chamber wall 32*a* or 32*b* not only along the axial direction x, but also along the circumferential direction φ. For example, the following may apply to a curvature ratio Δκ between a curvature $\kappa_{32}$ of the combustion chamber wall 32*a*, 32*b* and a curvature $\kappa_{34}$ of a shingle edge 341 of a combustion chamber shingle 34*a*, 34*b* that is affixed thereat depending on the spatial direction x or φ—respectively with regards to a (cold) mounting state of the combustion chamber assembly group:

1. for an inner combustion chamber shingle 34*a* in the axial direction (axis direction)$\times 1.03\leq\Delta\kappa<1.4$ and in the circumferential direction $\varphi 0.7<\Delta\kappa\leq 0.98$, with $\Delta\kappa=\kappa_{32}/\kappa_{34}$; and
2. for an outer combustion chamber shingle 34*b* in the axial direction (axis direction) x as well as in the circumferential direction $\varphi 1.03\leq\Delta\kappa<1.4$, with $\Delta\kappa=\kappa_{32}/\kappa_{34}$.

Once again schematically illustrated based on the flow chart of FIG. 5 is a possible flow of an embodiment variant of a proposed manufacturing method by means of which also a combustion chamber assembly group can be produced corresponding to FIGS. 1A to 3, for example.

Here, in a first method step A1, it is initially determined in a computer-aided manner based on the available operational data of the engine T and component data of the combustion chamber assembly group—in particular a natural frequency of a combustion chamber shingle 34*a*, 34*b*, thermal expansion coefficients of the combustion chamber shingle 34*a*, 34*b* and the combustion chamber wall 32*a*, 32*b*, as well as a temperature difference between the combustion chamber shingle 34*a*, 34*b* and the combustion chamber wall 32*a*, 32*b* that occurs during operation of the engine T—by which measure the curvatures of the combustion chamber wall 32*a*, 32*b* and of a shingle edge 341 of a combustion chamber shingle 34*a* or 34*b* have to differ from each other along the different spatial directions x and φ to ensure an abutment of the shingle edge 341 at the combustion chamber wall 32*a* or 32*b* with a predefined minimum clamping force K at least in certain sections of the shingle edge 341 during proper operation of the engine T. Based on the expected (calculated) deformations, a model for a basic geometry of the combustion chamber shingles 34*a*, 34*b* which are to be used in the combustion chamber BK is determined in a method step A2. In a method step A3, this model provides the basis for a deformation of the combustion chamber shingles 34*a*, 34*b*, so that the combustion chamber shingles 34*a*, 34*b* take the desired optimized abutment shape during the operative state. During operation of the engine T and in a state in which they are mounted at the combustion chamber wall 32*a*, 32*b*, the combustion chamber shingles 34*a*, 34*b* that are thus manufactured in a deformed manner will always abut the respective combustion chamber wall 32*a* or 32*b* with their shingle edge 341 with at least the minimum clamping force.

PARTS LIST

111 low-pressure compressor
112 high-pressure compressor
113 high-pressure turbine
114 medium-pressure turbine
115 low-pressure turbine
2 fuel nozzle
22 outer housing
32*a*, 32*b* inner/outer combustion chamber wall
33 preliminary turbine guide row
340 shingle base body
341 shingle edge
34*a*, 34*b* inner/outer combustion chamber shingle
35 admixing hole/mixed air hole
36 air supply
4 bolt
5 nut
A outlet
B bypass channel
C outlet cone
BK combustion chamber
BKA combustion chamber section
E inlet/intake
F fan
F1, F2 fluid flow
FC fan housing
K pressing force
$k_{32x}$, $k_{34x}$ curvature line
M central/rotational axis
S rotor shaft
T (turbofan) engine
TT turbine
V compressor
Z inflow direction

The invention claimed is:

1. A combustion chamber assembly group, comprising:

a combustion chamber for an engine that comprises a curved combustion chamber wall extending along two spatial directions, and a combustion chamber shingle that is affixed at an inner side of the combustion chamber wall and has a shingle edge that defines an outer contour of the combustion chamber shingle, the shingle edge including a central portion and end portions positioned on opposite sides of the central portion, wherein for an at least sectional abutment of the shingle edge at the combustion chamber wall at a minimum clamping force in an operational state of the engine, the combustion chamber shingle has a curvature at a section of the shingle edge that differs with respect to at least one of the two spatial directions from a curvature of the combustion chamber wall with respect to the at least one of the two spatial directions, in a mounting state in which the combustion chamber shingle is mounted at the combustion chamber wall;

wherein the end portions of the shingle edge remain in contact with the combustion chamber wall from the mounting state to the operational state and the difference between the curvature of the section of the shingle edge and the combustion chamber wall changes between the mounting state and the operational state to provide the minimum clamping force in the operational state of the engine, wherein with respect to one of the two spatial directions, the curvature of the shingle edge is smaller than the curvature of the combustion chamber wall, and wherein with respect to the other of the two spatial directions, the curvature of the shingle edge is larger than the curvature of the combustion chamber wall between the end portions.

2. The combustion chamber assembly group according to claim 1, wherein a ratio between the curvature of the combustion chamber wall and the smaller curvature at the section of the shingle edge is in a range from 1.03 to 1.4.

3. The combustion chamber assembly group according to claim 2, wherein the ratio between the curvature radius of the combustion chamber wall and the curvature radius at the section of the shingle edge is in a range from 1.03 to 1.2.

4. The combustion chamber assembly group according to claim 1, wherein a ratio between the curvature of the combustion chamber wall and the larger curvature at the section of the shingle edge is in a range from 0.7 to 0.98.

5. The combustion chamber assembly group according to claim 1, wherein the section of the shingle edge includes a first section and a second section and a first curvature radius at the first section of the shingle edge is larger with respect to a first spatial direction of the two spatial directions along which the combustion chamber wall extends than the curvature radius of the combustion chamber wall with respect to the first spatial direction, and a second curvature radius at the second section of the shingle edge is smaller with respect to a second spatial direction of the two spatial directions than the curvature radius of the combustion chamber wall with respect to the second spatial direction.

6. The combustion chamber assembly group according to claim 1, wherein the section of the shingle edge includes a first section and a second section and a first curvature radius at the first section of the shingle edge is larger with respect to a first spatial direction of the two spatial directions along which the combustion chamber wall extends than the curvature radius of the combustion chamber wall with respect to the first spatial direction, and a second curvature radius at the second section of the shingle edge is also larger with respect to a second spatial direction of the two spatial directions than the curvature radius of the combustion chamber wall with respect to the second spatial direction.

7. The combustion chamber assembly group according to claim 1, wherein the combustion chamber wall extends along an axial direction which is parallel to a flow direction through the combustion chamber, and along a circumferential direction that extends along a circular path about the axial direction.

8. A gas turbine engine with a combustion chamber that comprises at least one combustion chamber assembly group according to claim 1.

9. A method for producing a combustion chamber assembly group, comprising:

providing a combustion chamber for an engine that comprises:

a curved combustion chamber wall extending along two spatial directions, and a combustion chamber shingle that is to be affixed at an inner side of the combustion chamber wall and has a shingle edge that defines the outer contour of the combustion chamber shingle, the shingle edge including a central portion and end portions positioned on opposite sides of the central portion, wherein for a sectional abutment of the shingle edge at the combustion chamber wall with a minimum clamping force in an operational state of the engine, the combustion chamber shingle is mounted to the combustion chamber wall in a mounting state in which the combustion chamber shingle at a section of the shingle edge has a curvature with respect to at least one of the two spatial directions that differs by a predetermined measure from a curvature of the combustion chamber wall with respect to the at least one of the two spatial directions;

wherein the end portions of the shingle edge remain in contact with the combustion chamber wall from the mounting state to the operational state and the difference between the curvature of the section of the shingle edge and the combustion chamber wall changes between the mounting state and the operational state to provide the minimum clamping force in the operational state of the engine, wherein with respect to one of the two spatial directions, the curvature of the shingle edge is smaller than the curvature of the combustion chamber wall, and wherein with respect to the other of the two spatial directions, the curvature of the shingle edge is larger than the curvature of the combustion chamber wall between the end portions.

10. The method according to claim 9, wherein the predetermined measure is determined depending on at least one chosen from a strength of the minimum clamping force, a natural frequency of the combustion chamber shingle, and on a temperature difference between the combustion chamber shingle and the combustion chamber wall in the operational state of the engine.

11. The method according to claim 9, wherein the predetermined measure is chosen in such a manner that a vibration of the section of the combustion chamber shingle relative to the combustion chamber wall is prevented in the operational state of the engine.

12. The method according to claim 9, wherein, the combustion chamber shingle is deformed and correspondingly curved to obtain the different curvature radii of the combustion chamber wall and the combustion chamber shingle.

13. The method according to claim 9, wherein the curvature radii of the combustion chamber wall and the combustion chamber shingle are adjusted to each other in order to obtain the sectional abutment of the section of the shingle edge with the minimum clamping force.

14. A combustion chamber assembly group, comprising:

a combustion chamber for an engine that comprises a curved combustion chamber wall extending along two spatial directions, and a combustion chamber shingle that is affixed at an inner side of the combustion chamber wall and has a shingle edge that defines an outer contour of the combustion chamber shingle, the shingle edge including a central portion and end portions positioned on opposite sides of the central portion, wherein for an at least sectional abutment of the shingle edge at the combustion chamber wall at a minimum clamping force in an operational state of the engine, the combustion chamber shingle has a curvature at a section of the shingle edge that differs with respect to at least one of the two spatial directions from a curvature of the combustion chamber wall with respect to the at least one of the two spatial directions, in a mounting state in which the combustion chamber shingle is mounted at the combustion chamber wall;

wherein the end portions of the shingle edge remain in contact with the combustion chamber wall from the mounting state to the operational state and the difference between the curvature of the section of the shingle edge and the combustion chamber wall changes between the mounting state and the operational state to provide the minimum clamping force in the operational state of the engine, wherein the section of the shingle edge includes a first section and a second section, a first curvature extending between two of the end points at the first section of the shingle edge is smaller, with respect to a first spatial direction of the two spatial directions along which the combustion chamber wall extends, than the curvature of the combustion chamber wall extending between the two end points of the first curvature with respect to the first spatial direction, and a second curvature extending between two of the end points at the second section of the shingle edge is also smaller, with respect to a second spatial direction of the two spatial directions, than the curvature of the combustion chamber wall extending between the two end points of the second curvature with respect to the second spatial direction.

* * * * *